United States Patent [19]

Brown

[11] 4,189,808

[45] Feb. 26, 1980

[54] RETAINER AND CLOSURE FOR A GARBAGE CAN LINER BAG

[76] Inventor: Theodore G. Brown, 5005 Stockton Blvd., Sacramento, Calif. 95820

[21] Appl. No.: 944,144

[22] Filed: Sep. 20, 1978

[51] Int. Cl.[2] ..... B65D 77/10

[52] U.S. Cl. ..... 24/30.5 R; 24/30.5 L

[58] Field of Search ..... 24/30.5 L, 30.5 S, 255 BS, 24/DIG. 28, 143 B; 220/404; 85/36; 248/314

[56] References Cited

U.S. PATENT DOCUMENTS

| | | | |
|---|---|---|---|
| 1,242,139 | 10/1917 | Callahan | 24/30.5 S |
| 1,608,901 | 11/1926 | Miller | 220/404 |
| 1,981,813 | 11/1934 | Schuster | 24/90 E |
| 2,070,005 | 2/1937 | Dom | 85/36 |
| 2,318,640 | 5/1943 | Simmonds | 85/36 |
| 2,551,196 | 5/1951 | Ballov | 24/257 |
| 3,212,391 | 10/1965 | Duffy | 85/36 |
| 3,326,509 | 6/1967 | Kuttler | 85/76 |
| 3,348,595 | 10/1967 | Stevens | 24/30.5 S |
| 3,877,103 | 4/1975 | Nash | 248/314 |
| 4,027,774 | 6/1977 | Cote | 220/404 |

FOREIGN PATENT DOCUMENTS

| | | | |
|---|---|---|---|
| 509036 | 2/1952 | Belgium | 24/255 BS |
| 459872 | 9/1968 | Switzerland | 24/30.5 S |
| 1399004 | 6/1975 | United Kingdom | 24/30.5 L |

*Primary Examiner*—William H. Schultz
*Attorney, Agent, or Firm*—John N. Randolph

[57] ABSTRACT

A button-like body formed of a thin elastic material is provided with a plurality of slots which intersect with one another adjacent the center of the body to define a plurality of triangular resilient prongs having adjacently disposed pointed inner ends located in close proximity to one another. The body, except for a rim portion, is cone-shaped with an upturned rim which surrounds a part of a convex outer side of the conical portion. Radially disposed reinforcing ribs are provided for the prongs on the concave inner side of the conical portion. The prongs are spread by a part of the open end of a garbage can liner bag, which is turned back over the rim of a refuse can, for drawing said part between the prongs from the concave to the convex side of the body, sufficiently to tighten the open mouth of the bag around the exterior of the can to prevent collapsing of the bag into the can. After the bag is substantially filled, the bag mouth is disengaged from the can and the remainder thereof is drawn through the button-like body to provide a closure for the filled bag.

4 Claims, 5 Drawing Figures

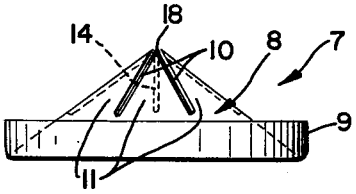
Fig.1
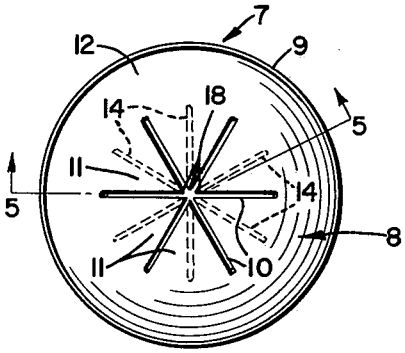
Fig.2
Fig.3
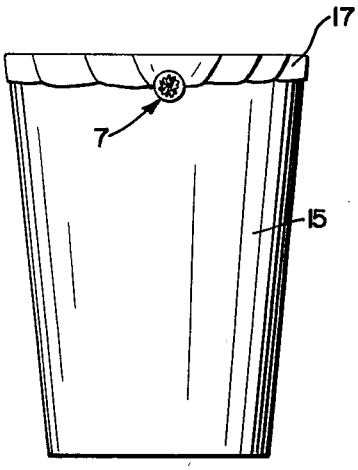
Fig.4
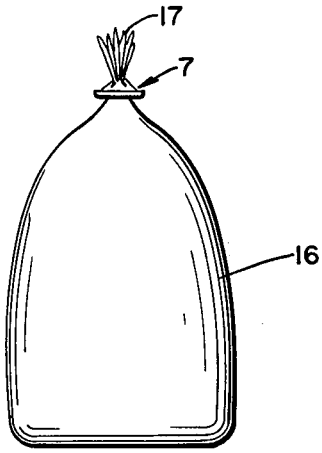
Fig.5
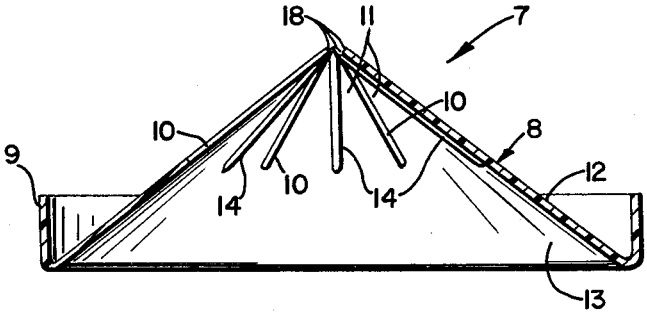

RETAINER AND CLOSURE FOR A GARBAGE CAN LINER BAG

BACKGROUND OF THE INVENTION

The art teaches the modification of refuse cans to provide means on the exterior of such cans, adjacent the rim, to which a part of the mouth of a liner bag can be attached for preventing the bag from collapsing into the can.

It is also common to provide ties, usually having a wire core, for closing the open mouth of a filled can liner bag.

SUMMARY

It is a primary object of the present invention to provide an inexpensive article which may be utilized initially for holding the open mouth of a can liner bag stretched around the exterior of the upper part of a trash or garbage can and which may thereafter be utilized to effectively close the open mouth of the filled bag.

More particularly, it is an object of the present invention to provide an inexpensive article which may function, without modification of a refuse can, for retaining the open mouth of a can liner bag stretched around the exterior of the upper portion of the can, and which will thereafter function after filling of the bag and its removal from the can to completely close the bag mouth.

Various other objects and advantages of the invention will hereinafter become more fully apparent from the following description of the drawing, and wherein:

BRIEF DESCRIPTION OF THE DRAWING

FIG. 1 is a side elevational view of the retainer and closure member;

FIG. 2 is an enlarged top plan view thereof;

FIG. 3 is a side elevational view of a refuse can containing a liner bag and showing the member applied to a part of the bag mouth for holding the bag mouth stretched around the exterior of the upper part of the can;

FIG. 4 is a side elevational view showing the same member functioning to a completely close the bag after it has been filled, and FIG. 5 is an enlarged sectional view taken substantially along the line 5—5 of FIG. 2.

DESCRIPTION OF THE PREFERRED EMBODIMENT

Referring more specifically to the drawing, the retainer and closure in its entirety and comprising the invention is designated generally 7 and comprises a button-like body formed of a thin elastic material, preferably plastic but which may constitute paper. The body 7 has a conical-shaped central portion 8 and a surrounding rim 9 which is turned up to surround a part of the central portion 8. The central portion 8 is provided with a plurality of straight slots 10 which intersect with one another intermediate of their ends and at the center of the portion 8, to form triangular-shaped prongs 11 located between the ends of the slots. The prongs 11 taper to points at their inner ends which are located in close proximity to the center of the body portion 8 which includes a convex outer side 12 and a concave inner side 13, see FIG. 5. Each prong 11 has a reinforcing rib 14 which extends radially from adjacent the center of the body portion 8 and which is disposed midway between the side edges of said prong. The ribs 14 are embossed on the concave inner surface 13 and function to increase the elasticity of the prongs 11.

FIG. 3 shows a conventional garbage or trash can 15 in which has been place a conventional liner bag 16 with the open mouth 17 of the bag turned back over the rim at the top of the can 15. The turned back mouth portion of the bag will normally not fit sufficiently tight around the exterior of the can 15 to prevent the bag 16 from collapsing into the can 15 and drawing its mouth portion 17 down into the can, so that the liner cannot be conveniently filled. However, by drawing a part of the mouth 17 out between the spread prongs 11 from the inner concave side 13, the mouth portion 17 can be restricted sufficiently so that the remaining portion thereof will fit snugly around the exterior of the top of the can 15 to prevent the bag from collapsing into the can. The resiliency of the prongs 11 will cause said prongs to spring back toward their normal positions of FIGS. 1, 2 and 5, after a part of the bag mouth 17 has been drawn outwardly therethrough, so that said bag mouth portion will be gripped by the pointed inner ends 18 of the prongs 11 and will be prevented from being drawn back through the body member 7 from its convex side 12 toward its concave side 13.

After the bag 16 has been substantially filled in the can 15, the mouth portion 17 can be forcibly pulled out of engagement with the open top of the can and the remainder of the bag mouth 17 can then be pulled through the body 7 from its inner concave side 13 for completely closing the mouth of the bag, as seen in FIG. 4, so that the bag 16 and its contents will be ready to be disposed of.

The upturned rim 9 provides a finger-hold by means of which the member 7 can be readily gripped between the fingers while drawing parts of the bag mouth 17 through the opening formed in the central portion 8 by the spreading of the prongs 11.

Various modifications and changes are contemplated and may be resorted to without departing from the function or scope of the invention.

I claim as my invention:

1. A retainer and closure for a garbage can liner bag consisting of a body member formed of a thin elastic material having a plurality of slots which intersect with one another intermediate of their ends to form resilient prongs, said prongs tapering in width toward the point of intersection of said slots to define adjacently disposed pointed ends, said prongs being adapted to be spread by the insertion of a part of the mouth of a can liner bag through the body from one side thereof for restricting the bag mouth to retain it around the exterior of the open top of a garbage or trash can in which the remainder of the bag is disposed, the remainder of the bag mouth being adapted to be drawn through the body member in the same direction, after the bag is substantially filled and the bag mouth has been detached from the can, for completely closing the bag ready for disposal with said retainer or closure supported solely by the bag, said body member being conical, and including an upturned rim surrounding the enlarged part only of the cone and forming a finger-hold.

2. A retainer and closure as in claim 1, each of said prongs having a reinforcing rib extending lengthwise thereof and embossed on the concave side of the body to increase the resiliency of the prong.

3. A retainer and closure as in claim 1, each prong having a reinforcing rib embossed on one side thereof for increasing the resiliency of the prong.

4. A retainer and closure as in claim 1, said body being formed of a plastic material.

* * * * *